United States Patent [19]

Bailey et al.

[11] Patent Number: 4,939,346

[45] Date of Patent: Jul. 3, 1990

[54] BULK MATERIAL PROCESSOR AND METHOD

[75] Inventors: Richard G. Bailey, Overland Park, Kans.; Merton R. Leggott, Lincoln, Nebr.

[73] Assignee: Flakee Mills, Inc., Lincoln, Nebr.

[21] Appl. No.: 283,238

[22] Filed: Dec. 12, 1988

[51] Int. Cl.[5] ..... F27B 7/18; F26B 23/04; F26B 17/32

[52] U.S. Cl. ..... 219/388; 219/389; 432/106; 432/118; 34/128

[58] Field of Search ..... 219/388, 389, 405, 411, 219/390; 432/106, 107, 108, 117, 118; 34/112, 126, 128, 142, 129

[56] References Cited

U.S. PATENT DOCUMENTS

| | | | |
|---|---|---|---|
| 95,351 | 9/1869 | Hull | 34/128 |
| 1,015,796 | 1/1912 | Gerlach | 34/128 |
| 2,189,206 | 2/1940 | Griffin | 219/389 |
| 2,319,673 | 5/1943 | French | 34/128 |
| 2,571,555 | 10/1951 | Fernandes | 34/142 |
| 2,683,594 | 7/1954 | Martenson | 34/128 |
| 2,887,788 | 5/1959 | Baxter | 34/128 |
| 3,396,953 | 8/1968 | Sandbrook | 34/128 |
| 3,944,651 | 3/1976 | D'Souza | 219/389 |

FOREIGN PATENT DOCUMENTS

| | | | |
|---|---|---|---|
| 161887 | 1/1958 | Sweden | 432/108 |

*Primary Examiner*—Teresa J. Walberg
*Attorney, Agent, or Firm*—Litman, McMahon & Brown

[57] ABSTRACT

A bulk material processor includes a barrel assembly with first and second ends, the first end having an inlet and an outlet. A rotor assembly is rotatably mounted within the barrel assembly and includes a screw auger positioned within a generally cylindrical body. Vanes extend longitudinally along the rotor body and project outwardly therefrom. A feeder assembly delivers bulk material to the barrel assembly inlet for augering through the rotor assembly. Upon exiting the rotor assembly, the material is swept around the inside of the barrel assembly for intermittent exposure to infrared radiation from a heater assembly mounted on top of the barrel assembly.

18 Claims, 3 Drawing Sheets

ROTATIONAL AXIS

R.A.

Fig. 9.
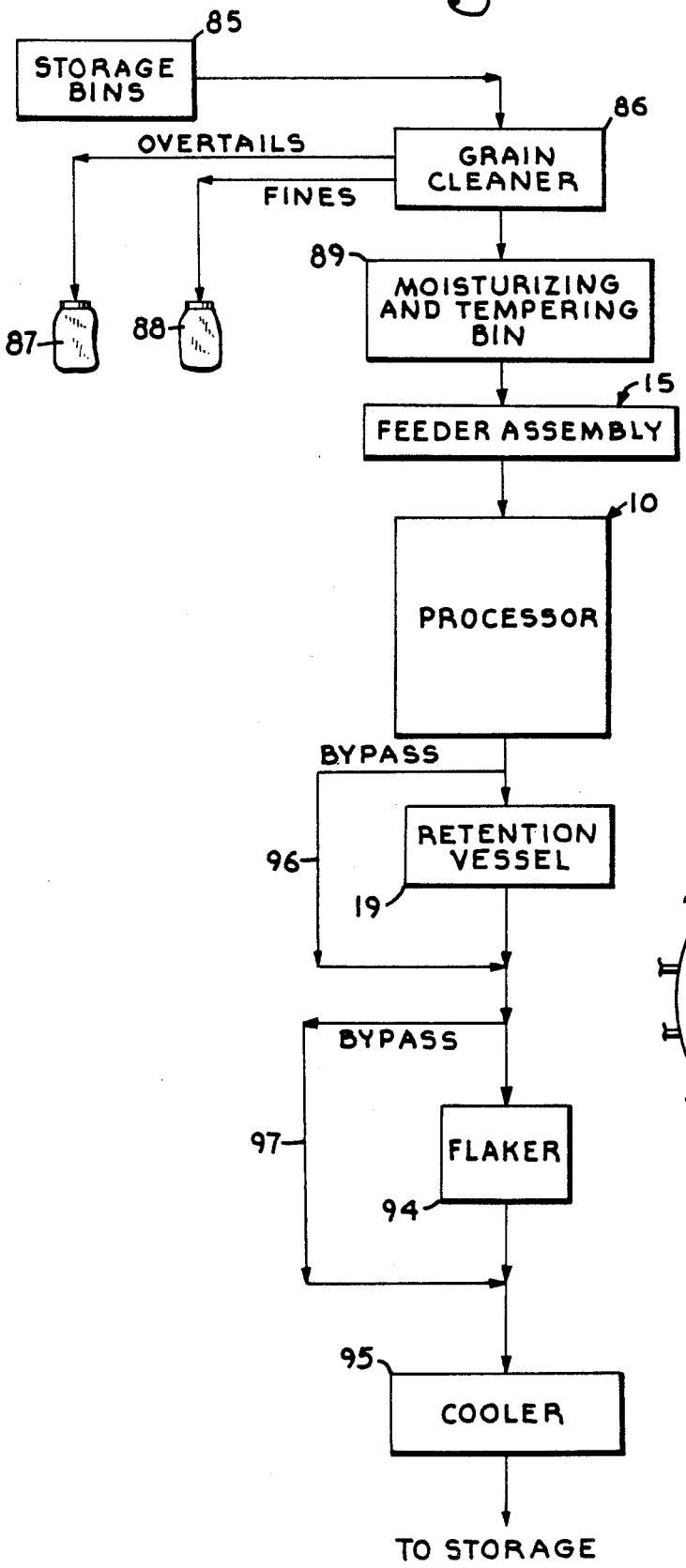
Fig. 8.
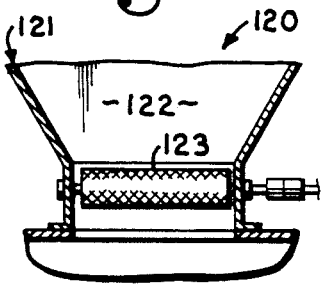
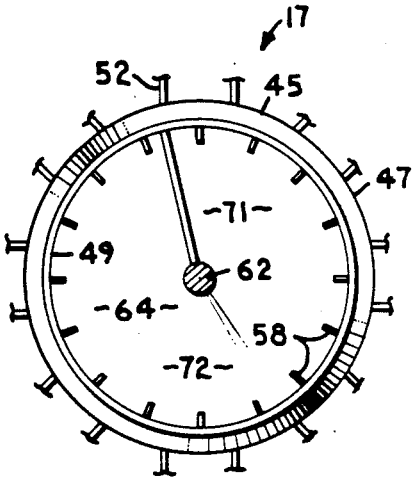
Fig. 7.

BULK MATERIAL PROCESSOR AND METHOD

BACKGROUND OF THE INVENTION

1. Field of the Invention.

The present invention relates generally to bulk material processing, and in particular to processing food and feed materials with infrared radiation.

2. Description of the Prior Art.

In the field of bulk material processing, various material processing methods include heating the materials. For example, when dehulled oats ("groats") are processed as food products they are normally heated to a predetermined temperature range. The heat controls the lipase enzymes which are present in the groats and prevents them from becoming rancid. For a discussion of lipase and related enzymes in oats, and their control, see *Oats: Chemistry and Technology,* (F. Webster ed. 1986). Steamers have heretofore been used to control lipase activity in oats. However, steamers tend to consume relatively large amounts of energy and add relatively large amounts of moisture to the groats.

Belt-type conveyors have also previously been employed in the bulk material processing field for conveying a flow of material being processed under a heat source. However, heretofore there has not been available a bulk material processor with the advantages and features of the present invention.

SUMMARY OF THE PRESENT INVENTION

In the practice of the present invention, a bulk material processor and method of operation are provided which avoid some of the problems associated with previous processors and processing methods. A bulk material processor is provided which includes a structural assembly with a framework and an enclosure. A barrel assembly is located within the enclosure and includes a first end with inlet and outlet openings and a second end. A rotor assembly is rotably mounted within the barrel assembly and includes a screw auger positioned within a generally cylindrical rotor body. Vanes project outwardly from and extend longitudinally along the rotor body. A heater assembly including infrared heater tubes is mounted on top of the barrel assembly for communicating radiation with its interior. A feeder assembly delivers bulk material to the barrel assembly inlet and includes a screw auger in one embodiment of the invention and a rotary feeder in another embodiment.

In the method of the present invention bulk material is delivered to the barrel assembly by the feeder assembly and is augered through the rotor assembly, wherein it is preheated. Upon exiting the rotor assembly, the material reverses its direction of flow and is turned within the barrel assembly by the longitudinal rotor vanes as it flows towards the barrel assembly outlet.

Energy efficiency is optimized by using infrared radiant heat and by providing a flow path for the material wherein initially it is augered through the middle of the barrel assembly by the rotor assembly for preheating and is thereafter conveyed around the outside of the rotor assembly for intermittent exposure to infrared radiation. Such intermittent exposure to radiation results in cooking the product in a relatively energy-efficient manner.

BRIEF DESCRIPTION OF THE DRAWINGS

FIG. 7 is a fragmentary, vertical, transverse, cross-sectional view of the processor taken generally along line 7—7 in FIG. 3 and particularly showing a rotor assembly thereof.

FIG. 8 is a fragmentary, vertical, transverse, cross-sectional view of a feeder assembly for a modified embodiment of the present invention.

FIG. 9 is a schematic flow chart of a bulk material processing method of the present invention.

DETAILED DESCRIPTION OF THE PREFERRED EMBODIMENTS

Figures 1, 3, 6:
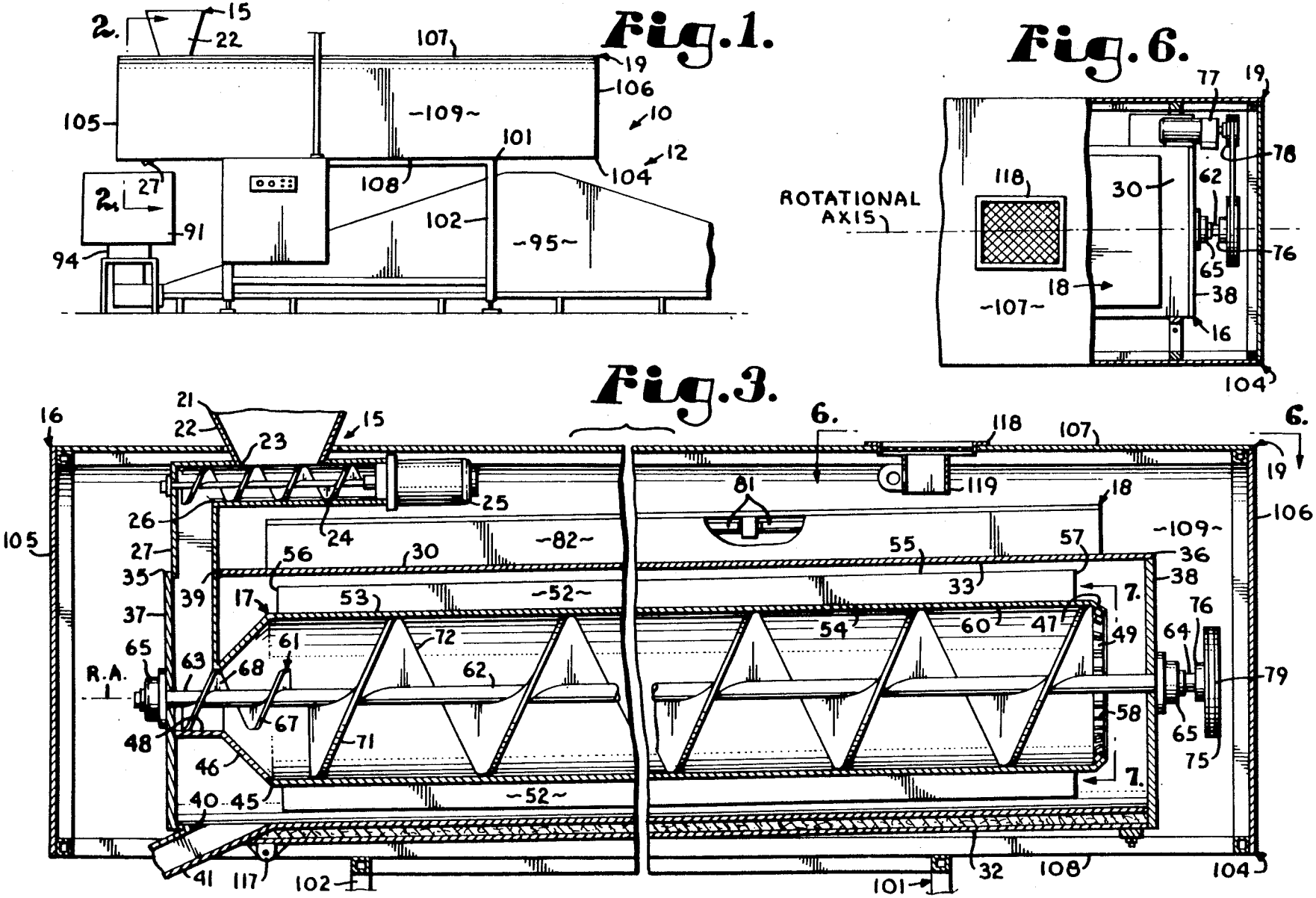
FIG. 1 is a side elevational view of a bulk material processing system including a processor embodying the present invention and adapted for a material processing method according to the method of the present invention.
FIG. 3 is a fragmentary, vertical, longitudinal, cross-sectional view of the processor taken generally along line 3—3 in FIG. 2.
FIG. 6 is a fragmentary, top plan view of the processor taken generally along line 6—6 in FIG. 3, with portions broken away to reveal internal construction.
Figure 4:
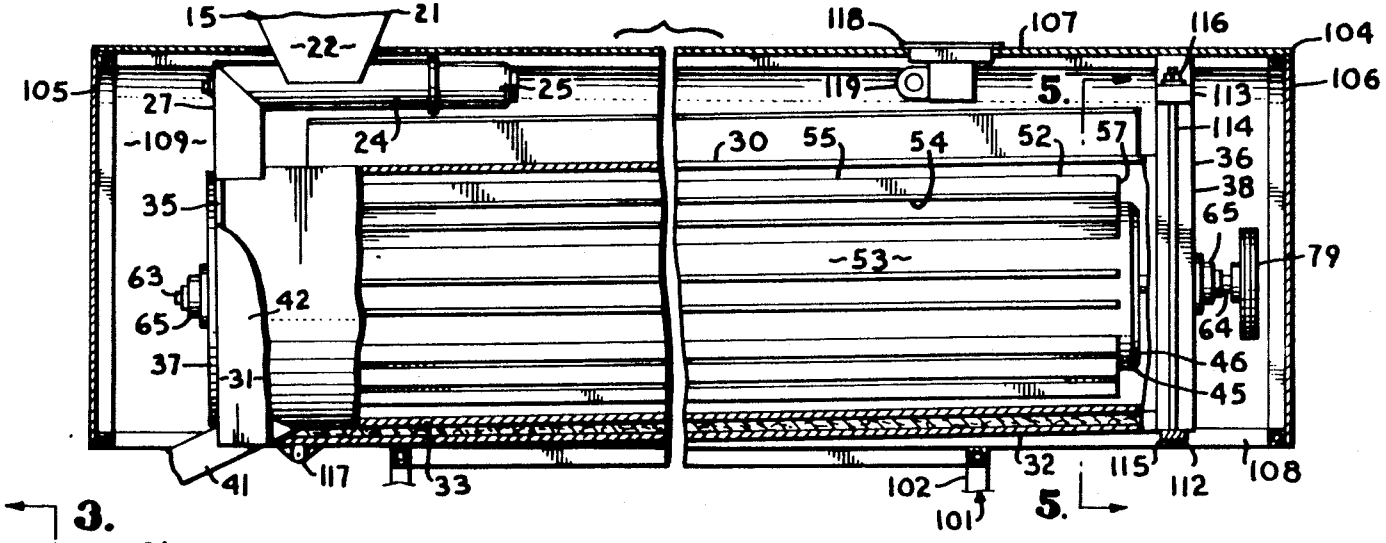
FIG. 4 is a fragmentary, vertical, longitudinal, cross-sectional view of the processor taken generally along line 4—4 in FIG. 2.

I. Introduction and environment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numberal 10 generally designates a processor for bulk material 11. The processor 10 is incorporated in a processing system 12, which is shown schematically in connection with a bulk material processing method in FIG. 9.

The processor 10 generally comprises a feeder assembly 15, a barrel assembly 16, a rotor assembly 17, a heater assembly 18 and a structural assembly 19.

II. Feeder Assembly 15.

The feeder assembly 15 includes a feed hopper 21, which may have a funnel-shaped configuration with side walls 22 converging downwardly to a feeder inlet 23. An auger 24 receives the material 11 from the inlet 23 and is driven by a variable speed motor 25. The material 11 is conveyed by the auger 24 to a feeder outlet 26 communicating with a vertically oriented downspout 27.

III. Barrel Assembly 16.

Figure 5:
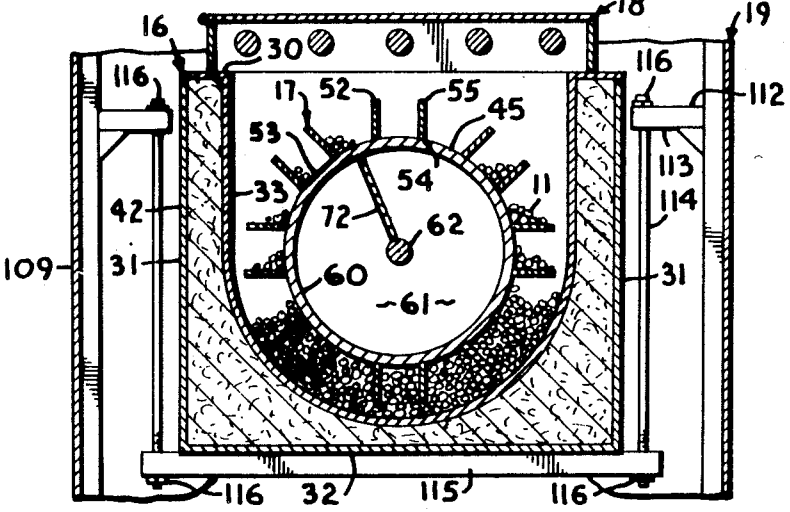
FIG. 5 is a fragmentary, vertical, transverse, cross-sectional view of the processor taken generally along line 5—5 in FIG. 4.
Figure 2:
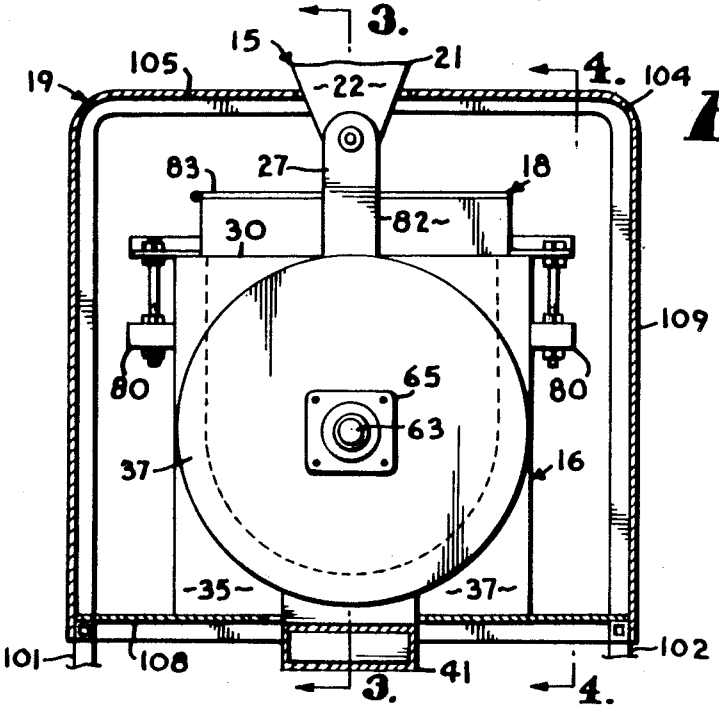
FIG. 2 is a vertical, transverse, cross-sectional view of the processor taken generally along line 2—2 in FIG. 1.

The barrel assembly 16 has a generally trough-shaped configuration with a U-shaped cross-sectional configuration (FIG. 5). The barrel assembly 16 has an open top 30, opposite sides 31 and a semi-cylindrical bottom 32. Opposite first and second barrel ends 35, 36 are closed by first and second end plates 37, 38 respectively. An inlet 39 at the first end 35 communicates with the downspout 27. An outlet 40, also at the first end 35, communicates with a discharge chute 41. A barrel bore 33 extends between the barrel ends 35, 36. An insulated barrel shroud 42 covers the barrel sides and bottom 31, 32.

IV. Rotor Assembly 17.

The rotor assembly 17 includes a generally cylindrical body 45 with tapered first and second ends 46, 47 whereat the body 45 converges to inlet and outlet openings 48, 49 respectively. A plurality of strip-like material transport vanes 52 extend longitudinally along and outwardly from a body outer surface 53 in generally parallel-spaced relation with respect to a rotor rotational axis and in generally radially-spaced relation with respect to each other. The vanes 52 may be arranged in pairs, and eight pairs (sixteen vanes total) may be provided as shown in FIG. 5.

Each vane 52 includes an inner edge 54 attached (e.g. welded) to the body outer surface 53, an outer edge 55 forming a clearance C with the barrel assembly bore 33 and first and second ends 56, 57 positioned in closely-spaced proximity to the body ends 46, 47.

A rotor bore 60 extends longitudinally and coaxially between the rotor ends 46, 47 and receives a screw auger subassembly 61.

A plurality of radially-oriented, circumferentially-spaced distribution tabs 58 are placed on the inside of the rotor bore 60 adjacent to its second end 57. The screw auger subassembly 61 includes a coaxial drive shaft 62 with first and second ends journaled in bearing assemblies 65 mounted on the barrel end plates 37, 38. A first screw auger section 67 has a diameter which permits it to be received in the rotor body inlet opening 48 and includes a single screw flight 68. The first screw auger section 67 is positioned within the rotor body inlet opening 48 and terminates in closely-spaced relation on either side of it.

A second screw auger section 71 has a single screw flight 72 with an outside diameter greater than a diameter of the first screw auger section 67, and extends therefrom throughout most of the length of the rotor body 45, terminating in closely-spaced relation to the second rotor end 47.

A rotor drive subassembly 75 is provided for driving the rotor assembly 17 and includes a shaft sprocket 76 mounted on the drive shaft second end 64 and a motor 77 with a motor sprocket 78 drivingly connected to the shaft sprocket 76 by a chain 79.

V. Heater Assembly 18.

The heater assembly 18 includes a bank of heater tubes 81 mounted within an open-bottom, reflective housing 82 which is mounted over the barrel assembly open top 30 for directing radiation from the heat tubes 81 into the interior of the barrel assembly 16. The heater tubes 81 may emit radiation in the infrared range when connected to a source of electrical power (not shown). Although the heater assembly 18 is described with tube elements 81 for producing infrared radiation with electrical power, infrared radiation may also be produced from the combustion of fossel fuels, such as natural gas. Other heater means could be substituted in place of the heater tubes 81, such as a source of convection heat.

In proximity to the barrel assembly first end 35 the heater assembly 18 is adjustably mounted on the barrel assembly 16 by a pair of elevating subassemblies 80 whereby an end of the heater assembly 18 may be raised to achieve a desired spacing over the material 11. The reflective housing 82 includes a hinged top 83 which provides access to the heater tubes 81.

A chromalox CPL and CPH wide area, flat surface infrared heater section may be utilized. Such heater sections can produce infrared radiant power in the range of approximately 0.5 to 3.6 kilowatts per square foot, with radiation wave lengths in the infrared range of approximately 2.5 to 7.9 microns at emitter temperatures of approximately two hundred degrees F to sixteen hundred degrees F.

VI. Structural Assembly 19.

The structural assembly 19 includes a framework 101 with four upright columns 102 for elevating the processor 10. An enclosure 104 is mounted on the columns 102 and includes front and back ends 105, 106, a top 107, a bottom 108 and opposite sides 109. The barrel assembly 16 is supported in proximity to its second end 36 by a suspension subframe 112 including a pair of support stanchions 113 affixed to and projecting laterally inwardly from the enclosure 104 into its interior. Each stanchion 113 receives a threaded tension rod 114 which depends downwardly therefrom. At their lower ends, the tension rods 114 are connected by a transverse suspension beam 115, upon which the second end 36 of the barrel assembly 16 rests. The tension rods 114 receive nuts 116 which are threadably adjustable for raising and lowering the beam 115. In proximity to its first end 35, the barrel assembly 16 is connected to the enclosure 104 by a hinge mechanism 117 with a transverse pivotal axis. Thus, the slope of the barrel assembly 16 can be adjusted with the suspension subframe 112. A vent subassembly 118 is provided in the enclosure top 107 and includes a motorized fan 119 for exhausting steam from the interior of the enclosure 104.

VII. Modified Embodiment Processor 120.

A processor 120 comprising a modified embodiment of the present invention is shown in FIG. 8 and includes a rotary feeder assembly 121 in place of the auger feeder assembly 15 of the previously described processor embodiment 10. The rotary feeder assembly 121 includes a feed hopper 122 for feeding material to a feed cylinder 123, which is driven by a variable speed motor (not shown) and is thereby adapted for controlling the flow rate of material to the processor 120.

VIII. Method of Operation and Processing System Components.

A method of processing bulk material 11 with the processor 10 as a component in the processing system 12 will be described, along with the functions of the various components of the processing system 12. The processing method will be described in connection with dehulled oats, which are commonly referred to as groats. However, various other bulk materials could be processed with the method and the processor 10 of the present invention, including cereal grains, vegetable beans, nuts (including fines and slivers), cocoa beans, coffee beans, animal feed materials and other organic materials requiring bacteria control. The oat groats (or groat material) 11 are conveyed from a storage bin 85 to a grain cleaner 86 whereat overtails and fines are removed to overtail and fine receptacles 87, 88 respectively. The cleaned oat groats 11 are conveyed to a moisturizing and tempering bin 89 whereat the moisture content may be altered to, for example, 16.5 percent. Alternatively, the moisture could be added in the storage bin 85.

The feeder assembly 15 next receives the groats 11 from the moisturizing and tempering bin 89 through the feed hopper 21 to the feeder auger 24. The feeder or dosing assembly 15 determines the throughput of the processor 10 and the entire processing system 12. The throughput is adjustable by adusting the speed of the feeder assembly motor 25. Groats 11 dispensed from the feeder assembly 15 enter the barrel assembly inlet 39 via the downspout 27, which receives the groat material 11 from the feeder outlet 26.

The rotor assembly 17 is rotated about its rotational axis by the motor 77 in a direction for augering the groat material 11 along a generally helical path of travel through the rotor bore 60 from the rotor first end 46 to the rotor second end 47. The first screw auger section 67 communicates the material through the rotor body inlet opening 48 and into the rotor bore 60, whereat the second screw auger section 71 engages the incoming groat material 11. The entire rotor assembly 17 is preferably formed from a thermally conductive material, such as steel, whereby the groat material 11 is preheated as it is augered through the rotor bore 60.

Upon discharge from the rotor outlet opening 49, the preheated groat material 11 reverses its general longitudinal direction of travel and moves through the annular space between the rotor body outer surface 53 and the barrel assembly 16 in a direction from the barrel assembly second end 36 to its first end 35 (i.e. right to left as shown in FIG. 3). The downward slope of the barrel and rotor assembly 16, 17 from the barrel assembly second end 36 to its first end 35 tends to advance the groat material 11 by gravity. The rotor vanes 52 function to rotate the groat material 11 during the second part of its passage through the barrel assembly 16 by engaging the material and sweeping it in a generally helical path of movement around the barrel assembly bore 33. As the material 11 passes under the open top 30 of the barrel assembly 16, it is exposed to infrared radiation from the heater assembly 18. In this manner the groats material 11 is subjected to intermittent intervals of direct infrared radiation for relatively uniform cooking of the entire throughput of the processor 10.

The temperature which the groat material 11 may reach in the processor 10 before discharge through the discharge chute 41 via the outlet 40 may be in the range of two hundred and five degrees F (ninety-six degrees C). The total travel time of groat material 11 through the processor 10 may be in the range of, for example, four minutes. From the discharge chute 41 the heated groat material 11 passes to a retention vessel 91, whereat the groat material 11 may be retained for approximately two mintues as an example. Retention vessels such as that shown at 91 are commercially available and may comprise, for example, stainless steel for resistance to the rusting and corrosive effects of the groat material 11. From the retention vessel 91 the groat material 11 may enter a flaker 94 if flakes are the desired finished product. From the flaker 94 the material 11 is conveyed to a cooler 95 and from there to storage. A retention vessel bypass 96 and a flaker bypass 97 are provided for selectively bypassing these steps in a particular process.

It is to be understood that while certain forms of the present invention have been illustrated and described herein, it is not to be limited to the specific forms or arrangement of parts described and shown.

What is claimed and desired to be secured by Letters Patent is as follows:

1. A processor for bulk material, which includes:

(a) a barrel assembly having:
  (1) first and second opposite ends;
  (2) a bore extending longitudinally between said first and second ends;
  (3) a top with an opening to said bore extending longitudinally between said first and second ends;
  (4) a bottom;
  (5) opposite sides;
  (6) an inlet to said bore located in proximity to said first ends;
  (7) an outlet from said bore located in proximity to said first end; and
  (8) insulation means thermally insulating said barrel assembly sides and bottom;

(b) a rotor assembly having:
  (1) a generally cylindrical rotor body with a first end having a frusto-conical configuration converging on an inlet opening, a second end having a generally frusto-conical configuration converging an outlet opening, and a rotor bore extending longitudinally between said inlet and outlet openings;
  (2) a rotational axis extending coaxially through said rotor body;
  (3) a screw auger mounted generally within said rotor body bore and including a first section extending through said rotor body inlet and a second section extending from said first section to a position in proximity to said rotor body outlet, said screw auger second section having a greater diameter than said screw auger first section;
  (4) first and second bearings mounted on said barrel assembly first and second ends respectively;
  (5) said screw auger including a coaxial drive shaft with first and second ends journaled in said first and second bearings respectively; and
  (6) a plurality of rotor vanes extending longitudinally along and projecting radially outwardly from said rotor body, each said vane having an inner edge attached to said rotor body, a free outer edge, a first end located in proximity to said rotor body first end and a second end located in proximity to said rotor body second end;

(c) a drive assembly including a motor drivingly connected to said drive shaft second end and adapted for rotating said rotor assembly;

(d) a heater assembly including:
  (1) an open-bottom reflective enclosure mounted on said barrel assembly top over said opening therein; and
  (2) infrared heater means positioned within said enclosure and adapted for communicating infrared radiation with said barrel assembly interior;

(e) a feeder assembly adapted for conveying bulk material to said barrel assembly inlet;

(f) said processor being adapted for preheating bulk material within said rotor assembly, said rotor assembly vanes being adapted to simultaneously sweep bulk material around said barrel assembly bore and convey bulk materal from said barrel assembly second end to said barrel assembly first end whereby said material is intermittently exposed to direct infrared radiation from said infrared heater means;

(g) said heater assembly having first and second ends located in proximity to said barrel assembly first and second ends respectively; and (h) at least one of said heater assembly ends being vertically adjustable with respect to said barrel assembly.

2. A processor for bulk material, which includes:

(a) a barrel assembly having:

(1) first and second opposite ends;

(2) a bore extending longitudinally between said first and second ends;

(3) a top with an opening to said bore extending longitudinally between said first and second ends;

(4) a bottom;

(5) opposite sides;

(6) an inlet to said bore located in proximity to said first ends;

(7) an outlet from said bore located in proximity to said first end; and (8) insulation means thermally insulating said barrel assembly sides and bottom;

(b) a rotor assembly having:

(1) a generally cylindrical rotor body with a first end having a frusto-conical configuration converging on an inlet opening, a second end having a generally frusto-conical configuration converging an outlet opening, and a rotor bore extending longitudinally between said inlet and outlet openings;

(2) a rotational axis extending coaxially through said rotor body;

(3) a screw auger mounted generally within said rotor body bore and including a first section extending through said rotor body inlet and a second section extending from said first section to a position in proximity to said rotor body outlet, said screw auger second section having a greater diameter than said screw auger first section;

(4) first and second bearings mounted don said barrel assembly first and second ends respectively;

(5) said screw auger including a coaxial drive shaft with first and second ends journaled in said first and second bearings respectively; and (6) a plurality of rotor vanes extending longitudinally along and projecting radially outwardly from said rotor body, each said vane having an inner edge attached to said rotor body, a free outer edge, a first end located in proximity to said rotor body first end and a second end located in proximity to said rotor body second end;

(c) a drive assembly including a motor drivingly connected to said drive shaft second end and adapted for rotating said rotor assembly;

(d) a heater assembly including:

(1) an open-bottom reflective enclosure mounted on said barrel assembly top over said opening therein; and (2) infrared heater means positioned within said enclosure and adapted for communicating infrared radiation with said barrel assembly interior;

(e) a feeder assembly adapted for conveying bulk material to said barrel assembly inlet;

(f) said processor being adapted for preheating bulk material within said rotor assembly, said rotor assembly vanes being adapted to simultaneously sweep bulk material from said barrel assembly bore and convey bulk material from said barrel assembly second end to said barrel assembly first end whereby said material is intermittently exposed to direct infrared radiation from said infrared heater means; and (g) said rotor assembly including a plurality of radially-spaced tabs projecting radially inwardly into said rotor bore adjacent to the second end thereof, said tabs being adapted to disperse bulk material around said barrel assembly bore in proximity to its second end.

3. A processor bulk material, which includes:

(a) a barrel assembly having:

(1) a first end;

(2) a second end;

(3) a bore extending longitudinally between said ends;

(4) a material inlet to said bore at said first end; and (5) a material outlet from said bore at said first end;

(b) a rotor assembly having:

(1) a generally cylindrical rotor body with first and second ends and inner and outer surfaces, a rotor bore extending between said ends and inlet and outlet openings at said first and second ends respectively;

(2) said rotor inlet communicating with said barrel assembly inlet;

(3) a screw auger positioned n said rotor bore and extending longitudinally therethrough;

(4) a longitudinally-extending rotational axis; and (5) a plurality of rotor vanes extending longitudinally along and projecting radially outwardly from said rotor body, each said vane having an inner edge attached to said rotor body, a free outer edge, a first end located in proximity to said rotor body first end and a second end located in proximity to said rotor body second end;

(c) drive means connected to said rotor assembly and adapted for rotating said rotor assembly about said rotational axis within said barrel assembly; and (d) heater means mounted on said barrel assembly and adapted for heating material within said barrel assembly.

4. The processor according to claim 3 wherein:

(a) said rotor assembly extends generally coaxially through said barrel assembly.

5. The processor according to claim 4 wherein:

(a) said barrel assembly slopes downwardly from its second end to its first end.

6. The processor according to claim 3 wherein:

(a) said rotor body first and second ends converge at said inlet and outlet openings respectively.

7. The processor according to claim 1 wherein:

(a) said heater means comprises infrared radiation source means.

8. The processor according to claim 3 wherein:

(a) said barrel assembly includes an upper, longitudinally-extending opening; and (b) said heater means is mounted on said barrel assembly whereby infrared radiation is communicated through said opening to said barrel assembly bore.

9. A processor for bulk material, which includes:

(a) a barrel assembly having:

(1) first and second opposite ends;

(2) a bore extending longitudinally between said first and second ends;
(3) a top with an opening to said bore extending longitudinally between said first and second ends;
(4) a bottom;
(5) opposite sides;
(6) an inlet to said bore located in proximity to said first end;
(7) an outlet from said bore located in proximity to said first end; and
(8) insulation means thermally insulating said barrel assembly sides and bottom;

(b) a rotor assembly having:
(1) a generally cylindrical rotor body with a first end having a frusto-conical configuration converging on an inlet opening, a second end having a generally frusto-conical configuration converging an outlet opening, and a rotor bore extending longitudinally between said inlet and outlet openings;
(2) a rotational axis extending coaxially through said rotor body;
(3) a screw auger mounted generally within said rotor body bore and including a first section extending through said rotor body inlet and a second section extending from said first section to a position in proximity to said rotor body outlet, said screw auger second section having a greater diameter than said screw auger first section;
(4) first and second bearings mounted on said barrel assembly first and second ends respectively;
(5) said screw auger including a coaxial drive shaft with first and second ends journaled in said first and second bearings respectively; and
(6) a plurality of rotor vanes extending longitudinally along and projecting radially outwardly from said rotor body, each said vane having an inner edge attached to said rotor body, a free outer edge, a first end located in proximity to said rotor body first end and a second end located in proximity to said rotor body second end;

(c) a drive assembly including a motor drivingly connected to said drive shaft second end and adapted for rotating said rotor assembly;

(d) a heater assembly including:
(1) an open-bottom reflective enclosure mounted on said barrel assembly top over said opening therein; and
(2) infrared heater means positioned within said enclosure and adapted for communicating infrared radiation with said barrel assembly interior;

(e) a feeder assembly adapted for conveying bulk material to said barrel assembly inlet; and
(f) said processor being adapted for preheating bulk material within said rotor assembly, said rotor assembly vanes being adapted to simultaneously sweep bulk material around said barrel assembly bore and convey bulk material from said barrel assembly second end to said barrel assembly first end whereby said material is intermittently exposed to direct infrared radiation from said infrared heater means.

10. The processor according to claim 9 wherein:
(a) said barrel assembly slopes downwardly from said second end thereof to said first end thereof whereby gravitational flow of material from said barrel assembly second end to said barrel assembly first end is facilitated.

11. The processor according to claim 10, which includes:
(a) adjustment means adapted for adjustably raising and lowering said barrel assembly second end.

12. The processor according to claim 11, which includes:
(a) an enclosure having an interior with said barrel assembly mounted therein; and
(b) said adjustment means comprising a subframe attached to said enclosure and having a pair of threaded rods suspending said barrel assembly second end.

13. The processor according to claim 9 wherein said feeder assembly includes:
(a) a feed screw auger adapted to auger bulk material at a predetermined flow rate to said barrel assembly inlet.

14. The processor according to claim 9 wherein said feeder assembly includes:
(a) a rotary cylinder adapted to dispense bulk material to said barrel assembly inlet at a predetermined flow rate.

15. The processor according to claim 9 wherein:
(a) said infrared heater means comprises electrically-powered infrared heat tubes.

16. The processor according to claim 9 wherein:
(a) said infrared heater means comprises a gas-burning infrared heater.

17. The processor according to claim 9, which includes:
(a) an enclosure with an interior adapted to receive said barrel assembly, said rotor assembly and said heater assembly;
(b) said enclosure having an opening; and
(c) an exhaust fan communicating with said enclosure opening, said exhaust fan being adapted to expel exhaust from said enclosure interior.

* * * * *